United States Patent [19]

Ropp

[11] 4,351,749

[45] Sep. 28, 1982

[54] MOLECULAR GLASSES FOR NUCLEAR WASTE ENCAPSULATION

[75] Inventor: Richard C. Ropp, Warren, N.J.

[73] Assignee: Vitrex Corporation, Livingston, N.J.

[21] Appl. No.: 146,302

[22] Filed: May 5, 1980

Related U.S. Application Data

[63] Continuation-in-part of Ser. No. 964,120, Nov. 28, 1978, abandoned.

[51] Int. Cl.[3] ..... G21F 9/16

[52] U.S. Cl. ..... 252/629; 301/48

[58] Field of Search ..... 252/301.1 W, 629; 501/48

[56] References Cited

U.S. PATENT DOCUMENTS 3,365,578 1/1968 Grover et al. ..... 252/301.1 W 4,049,779 9/1977 Ropp ..... 423/309

4,087,511 5/1978 Ropp ..... 423/277

*Primary Examiner*—Deborah L. Kyle

*Attorney, Agent, or Firm*—Karl F. Milde, Jr.

[57] ABSTRACT

A molecular glass based upon a phosphate of aluminum, or other trivalent metal, provides significant improvement over prior art glasses for encapsulation of high level radioactive nuclear waste. When containing a controlled amount of those elemental oxides found in a typical nuclear waste, the waste-glass would not devitrify under conditions which produced devitrification in the non-nuclear-waste-containing glass, exhibited hydrolysis losses lower by an order of magnitude, had high solvency power for those elemental oxides, exhibited little tendency for internal crystallite formation, and possessed other desirable physical characteristics, all in direct antithesis to the properties of the best prior-known glasses used for this application.

62 Claims, No Drawings

MOLECULAR GLASSES FOR NUCLEAR WASTE ENCAPSULATION

REFERENCE TO RELATED APPLICATION

This is a continuation-in-part of my U.S. application Ser. No. 964,120 filed Nov. 28, 1978 now abandoned for "Molecular Glasses For Nuclear Waste Encapsulation".

BACKGROUND OF THE INVENTION

Radioactive waste has arisen from two major sources: production of nuclear weapons and production of nuclear energy. The waste can take at least three forms. By far the largest volume is liquid waste from commercial nuclear energy generating plants. To recover unused uranium and/or plutonium, the spent fuel rods are dissolved in nitric acid. After removal of these actinides, the strong acid wastes are neutralized and stored in steel tanks. The problem has been that the tanks corrode with subsequent leakage of high-level radioactive liquids into the biosphere.

One can convert the radioactive liquids to solid oxides but this physical form can also be dispersed fairly easily. These powders are generally referred to as calcines. The level of radioactivity from calcine is very high and of the order of 1.5 million rads (R) per hour as a dosage. After storage for a hundred years, the level will have dropped to 5800 R per hour but 1000 years storage is indicated before an acceptable dose-rate for humans arises. However, the above refers only to suburanic, or fission product wastes. If the actinides such as uranium and plutonium are not removed, then the wastes must be kept in secure storage for about 250,000 years before they can be considered safe for human exposure.

The volume of commercial waste (high level waste—HLW) is enormous. About 74 million gallons have existed, or will exist once the stored spend fuel rods are processed. Because of the lack of a really satisfactory disposal method for HLW, a major part of the spent fuel rods have been stored under water in underground bunkers. The United States has sufficient uranium stockpiled so that recovery of unused uranium from the spent fuel rods is not critical. However, this practice cannot continue indefinitely. Some of the liquid waste already produced has been converted to calcine. There is about 3.9 million (M) cubic feet of unprocessed liquid waste which will form some 585,000 cubic feet of calcine.

The second form of radioactive waste consists of actinide waste which has been separated from HLW and other sources. It amounts to about 1.8 M cubic feet of liquid waste. The third form of radioactive waste, weapons waste, amounts to about 75 M gallons, or about 9.6 M cubic feet. This waste is of lower radioactivity level than that of HLW from reprocessing of commercial fuel rods, which in turn is much less than that of separated actinide waste, as regards radioactive emissions level.

The use of glass for containment of high-level radioactive waste has been under development for many years. There are many attractive features of this mode of encapsulation. They include a rigid incorporation of the radioactive ions, or species, by dissolving them into the melt to form the glass structure. They are then not free to move as long as the glass structure is maintained. Glass is not subject to grain growth, surface oxidation, and other factors common to crystalline solids. However, there are six critical properties required for any glass in this application. These include: (1) minimal tendency to devitrify, (2) low hydrolytic leach rate, (3) high solvency power, (4) relatively low melt temperatures, (5) low tendency to form crystals from the added waste components, and (6) low softening point and viscosity of the melt.

Devitrification refers to the proclivity of an amorphous solid (glass) to become crystalline. All glass will devitrify provided that the internal temperature of the glass body is raised to a certain point called the devitrification temperature. The devitrification process is exothermic; that is, it releases heat, so that when devitrification starts, it is self-sustaining. The devitrification product consists of microcrystals so that the mass is friable and easily dispersed. It is therefore important to maintain the amorphous state for the HLW encapsulation application. The problem is that the incorporated HLW is a heat source through natural fission processes plus absorption of energy from the emitted radiation by the glass matrix. Internal temperatures of up to 850° C. have been observed. Thus all of the prior glasses used for this application have devitrified when the incorporated HLW has heated the glass to its devitrification temperature during storage. This remains a severe problem for which there has been no solution heretofore.

Since the HLW-glass is to be stored for prolonged times as a solid mass, the hydrolytic leach rate, as a loss at the surface of the glass body, is important. Ordinary window glass has a relatively high leach rate of $5.3\times10^{-4}$ gm/cm$^2$/hr in boiling water. A good waste-glass must have a value of at least 150 times smaller than this. Granite, an igneous rock, has a leach rate of about $4.6\times10^{-6}$ gm/cm$^2$/hr while that of marble is about $1.2\times10^{-5}$ gm/cm$^2$/hr. Since the waste-glass is to be stored in underground rock vaults, its hydrolytic leach rate ought to be less than the surrounding rock.

When the HLW is to be added to the glass melt, all of the components need to be dissolved. Many of them are refractory oxides such as $CeO_2$, $ZrO_2$ and $RuO_2$. A high solvency power of the melt is therefore needed. In most glasses, the addition of excess oxides to the glass melt tends to cause formation of insoluble crystallites as specific compounds which begin to recrystallize and grow larger. When the melt is cast, the crystals, as a second phase, form centers of internal strain, thereby causing the glass to develop cracks and become friable. Hence it is also desirable if the glass exhibits little or no tendency for internal crystallite formation.

Furthermore, the processing temperatures required for production of glass need to be relatively low for nuclear waste encapsulation, preferably not over 1400° C. Conservation of energy is one reason for this limitation while another is that the containers intended for actual storage of the waste-glass cannot stand processing temperatures in excess of this value. Finally, the glass melt also needs to have a low viscosity so that added waste oxides can be dispersed into the melt more easily.

The best glass known heretofore for the nuclear waste encapsulation application, a zinc borosilicate (ZBS), was developed especially for this purpose. A melt is produced at 1400° C. which has a viscosity of less than 200 poise. Up to 45% by weight of the HLW oxides can be dissolved into the melt. The hydrolytic leach rate is lower by an order of magnitude than most commercial glasses. Unfortunately, HLW-ZBS glass devitrifies at 750° C. and softens at 570° C. Refractory waste oxides such as $RuO_2$, $CeO_2$ and $ZrO_2$ do not dissolve at all well into the melt and crystallites of $Zn_2SiO_4$, $SrMoO_4$, $NdBSiO_5$ and $Gd_2Ti_2O_7$ are among the crystalline compounds observed to form in the glass or devitrified product.

SUMMARY OF THE INVENTION

I have found the use of a molecular glass, based upon a polymerized phosphate of aluminum (PAP), indium or gallium and made according to methods already given in U.S. Pat. No. 4,049,779 and U.S. Pat. No. 4,087,511, overcomes all of the prior objections to use of glass as a high-level nuclear waste encapsulation agent. This HLW glass product could not be made to devitrify, dissolved all of the oxides found in calcine, including the difficultly soluble ones, did not form microcrystallites in the melt or subsequent glass-casting, and possessed a hydrolytic etching rate to boiling water even lower than that of HLW-ZBS glass.

In accordance with the present invention, a precursor compound, $M(H_2PO_4)_3$, is prepared according to methods of U.S. Pat. No. 4,049,779, where M is a trivalent metal selected from a group consisting of aluminum, indium and gallium. Advantageously, the impurity level is carefully controlled so as not to exceed 300 ppm. total. The precursor crystals may be washed to remove excess phosphoric acid as desired. HLW is added to the crystals and the mixture is then heated at a controlled heating rate to induce said state polymerization and to form a melt at 1350° C. in which the HLW oxides dissolve rapidly. When aluminum was used, the resulting HLW-PAP glass had a hydrolytic leach rate to boiling water some 15.8 times lower than HLW-ZBS glass. The melt dissolved all components of the HLW and no crystallite formation was noted in the melt or in the finished glass form. The softening point of HLW-PAP glass is 650° C. It has a high thermal conductivity, a low thermal expansion which above 350° C. has been observed to become negative, possesses a low cross-section for absorption of radiation, and apparently does not require thermal annealing to relieve internal stress generated during casting of the melt to form the glass, like other prior known glasses.

Alternately, the HLW can be mixed with the formed precursor crystals plus phosphoric acid to form HLW phosphate compounds prior to melting the precursor crystals to produce the HLW glass composition. Another method which produces a very stable HLW glass substance involves the preparation of a solid prefire, by firing the precursor crystals at 1100° C. to form a calcine, to which the HLW is added. A melt is then formed at 1350° C., which is subsequently cast to produce the stable HLW glass block for long term storage. Still another alternate is the formation of the polymerized melt from the precursor crystals, followed by casting the melt to form a glass, to form a glass frit. The frit softens at 850° C. and HLW dissolves into the melt at 1150° C. rapidly to form the solidified HLW glass block as a final product for prolonged or permanent storage.

The glass composition employed for nuclear waste encapsulation according to the present invention has either the formula $M_3P_7O_{22}$ or the formula $M(PO_3)_3$. The glass may be a pure compound of either formula, or a mixture of the two. The $M(PO_3)_3$ may be prepared either by continuing the solid state polymerization, referred to above, for an extended time, or by precipitation from purified solutions of a soluble salt and metaphosphoric acid.

DESCRIPTION OF THE PREFERRED EMBODIMENTS

I have determined that a high degree of chemical durability of non-silicate glasses, such as those based upon phosphate, sulfate and the like, cannot be attained unless a precursor is first formed as a separate phase, heated to induce solid state polymerization of said phase, to form a melt, to form a polymerized glass. For encapsulation of high-level radioactive nuclear waste, a polymerized phosphate of aluminum is required, possessing a high degree of purity. The precursor compound is prepared by dissolving an aluminum compound in an excess of phosphoric acid. $Al(OH)_3$ is preferred as a source of aluminum although other aluminum compounds can be employed. It is important to maintain a certain molar ratio of $H_3PO_4$:$Al^{3+}$ in the solution. The minimum is about 6:1 mols per mol but 7:1 works much better, and ratios as high as 9:1 have been found useful. The higher ratios accelerate $Al(OH)_3$ dissolution, which may take 3–5 days at the 6:1 ratio. After purification of the resulting solution, controlled evaporation is employed to obtain the precursor crystals, $Al(H_2PO_4)_3$, with good yield. These crystals, of high crystallinity and regular morphology, are then washed with an organic solvent such as methyl-ethyl ketone or ethyl acetate, but not limited to those solvents, to remove excess $H_3PO_4$ to produce monobasic crystals uncontaminated by other chemical species or contained impurities. The presence of a large excess of $H_3PO_4$ during evaporation is essential, during the precursor crystal formation, to prevent the appearance of other unwanted phosphates of aluminum which will not undergo solid state polymerization when heated to elevated temperatures. Table I shows the analysis of a typical batch of precursor crystals used to prepare my new and improved glass for the nuclear waste encapsulation application.

TABLE I

Typical Analysis of Precursor Crystals Used to Prepare Polymeric Glass

| Impurity | ppm | Impurity | ppm |
|---|---|---|---|
| Mg | 10 | Pb | — |
| Si | 50 | Cr | 3 |
| Fe | 20 | Mn | — |
| Cu | — | Ca | 50 |
| Al | major | Na | 100 |
| Ni | — | Li | 15 |
| Sr | 3 | K | 30 |
| Mo | — | Ba | — |
| Co | — | V | — |

The glass product prepared by heating the precursor crystals has a novel stoichiometry not described or known heretofore. For a typical preparation, the analysis of washed and dried crystals was:

98.33% $Al(H_2PO_4)_3$
0.05% $H_3PO_4$
1.62% $H_2O$

Upon heating the precursor crystals in a suitable container, all of the absorbed water is lost by the time the temperature reaches 175° C. A loss of the three waters of constitution begins sequentially at 210° C. and is complete at 700° C., according to the reaction:

$$m\ Al(H_2PO_4)_3 \xrightarrow{\Delta} [Al(PO_3)_3]_m + 3\ H_2O \uparrow, \quad (1)$$

where m is an initial degree of polymerization, from m=1 to m=4. At about 870° C., the small amount of excess phosphoric acid is lost as $7H_3PO_4.3H_2O$. If a prefire or calcine is desired, the temperature is held at 1100°-1150° C. for several hours. If the temperature continues to rise, a further loss of $P_2O_5$ is observed above about 1200° C., according to the invention:

$$3\ [Al(PO_3)_3]_m \xrightarrow{\Delta} Al_3P_7O_{22} + m\ P_2O_5 \uparrow. \quad (2)$$

The loss of $P_2O_5$ accelerates above the melting point of 1325°-1350° C. and is complete by 1500° C. If the temperature is held at the melting point, the loss continues until the final stoichiometry given in reaction (2) is attained. This final stoichimetry is maintained while further polymerization continues. If the polymerization is allowed to continue for 30 hours or more, the stoichiometry begins to change further and crystals appear in the melt, according to the reaction:

$$n\ Al_3P_7O_{22} \xrightarrow{\Delta} [Al(PO_3)_3]_n + n\ AlPO_4 \downarrow. \quad (3)$$

The useful glass composition thus appears to be $Al_3P_7O_{22}$, or $Al(PO_3)_3$, or a mixture of both, depending upon the polymerization time.

A non-purified, washed precursor, estimated to contain about 4000 ppm of impurities, was further analyzed by Thermogravimetric Analysis to consist of:

98.14% $Al(H_2PO_4)_3$
1.84% $H_2O$
0.02% $H_3PO_4$

Upon heating, it behaved in an identical thermal manner and produced a glass composition, $Al_3P_7O_{22}$, when polymerized for 16 hours. An unwashed bath of precursor crystals was analyzed to be:

68.80% $Al(H_2PO_4)_3$
10.19% $H_2O$
21.01% $H_3PO_4$

Its thermal decomposition behavior was also identical to that described above. The reaction is thus not affected by the degree of impurity level nor by the presence of excess phosphoric acid.

The same nominal glass composition may be formed by precipitating $Al(PO_3)_3$ from a soluble salt and metaphosphoric acid, and then firing the product. The precipitation reaction is:

$$Al(NO_3)_3 + 3HPO_3 \rightarrow Al(PO_3)_3 \downarrow + 3HNO_3 \quad (4)$$

Both the soluble salt $[Al(NO_3)_3]$ and metaphosphoric acid should be purified solutions, preferably with an impurity level not exceeding 300 ppm. Although this method is much to be preferred over the methods taught in the prior art, such as that of Hatch, Canadian Pat. Nos. 449,983 and 504,835, it still suffers from several deficiencies. Although $HPO_3$ is very soluble in water, it tends to hydrolyze to $H_3PO_4$ rather easily so that the reaction (4), given above, is difficult to control without introducing other unwanted aluminum phosphates into the melt. In addition, contamination by the anion, in this case nitrate ion $NO_3^-$, interferes with subsequent reactions when the $Al(PO_3)_3$ is isolated, dried and then heated to form the glass melt. The worst method to use is the method of Hatch who teaches to combine $Al_2O_3$ and $H_3PO_4$ into a solid mass and then to fire the mass to fusion and quickly cool it. The resulting glass is subject to incipient recrystallization and is described as a very slowly water soluble dehydrated phosphate useful in water purification procedures. If an intermediate is not isolated, and if said intermediate is not of high purity, in contrast to the prior art, then the improved product of my new and improved invention does not result. The products of the prior art inventions suffer from lack of stability to recrystallization and lack of resistance to hydrolytic etching by boiling water, which characterize and uniquely set apart the product of my new and improved invention for encapsulation of high level nuclear waste. I have determined that it is much better to isolate the monobasic precursor, fire it to the prefire calcine, and then to form the glass melt. The prior art has taught to use 3.00 mols $H_3PO_4$ per mol of aluminum salt, but even if one uses my improved ratio of 7.00 mol $H_3PO_4$ per mol of Al salt and fires this mixture, the glass product remains inferior and lacks many of the improved properties of my new and novel invention. Even the properties of the glass obtained from melting the isolated precipitated product, $Al(PO_3)_3$, remain inferior to those of my new invention.

Observed physical properties of my new improved glass, $Al_3P_7O_{22}$, were determined to be:

| | |
|---|---|
| glass transition point | Tg = 790° C. |
| softening point | $T_{SP}$ = 820° C. |
| devitrification | $T_d$ = 1050° C. |
| melting point | $T_M$ = 1290° C. |

There is an endorthermic peak associated with $T_{sp}$ which is the heat of softening. For $Al_3P_7O_{22}$, $\Delta H_{SP}$ is estimated as 200 calories per mole. Its thermal conductivity is high and of the order of 0.53 cal.-cm/°C./cm²/sec. at 100° C., 1.28 cal.-cm./°C./cm²/sec. at 250° C., and 2.57 cal.-cm/°C./cm²/sec. at 500° C. One can extrapolate that at 750° C., the expected internal temperature for a HLW-glass form, my new glass will dissipate about 13.8 Kcal./cm²/hr. of energy, or nearly 14.9 Kilowatts per square foot of surface per hour. The expansion coefficient of my new glass is low in relation to prior glasses used in this application and more nearly matches that of the metal containers used for storage. When a frit melt is produced in a metal crucible, and estimate of expansion coefficient can be obtained by careful observation of the glass produced at a particular temperature, and the effect of change of temperature upon it. Above about 375° C. quenching temperature, the expansion coefficient appears negative (up to 600° C.) as shown by the increase in space between the crucible wall and the glass block, as temperature increases upwards from 375° C. Below about 275° C., the glass appears to have a positive expansion. The positive expansion is in the neighborhood of $30\times10^{-7}$ in./in./°C. to about $45\times10^{-7}$ in./in./°C. The negative expansion remains low, in the range of $-7\times10^{-7}$ in./in./°C. to about $-11\times10^{-7}$ in./in./°C. These expansion properties can be controlled somewhat by the polymerization time used. It is quite obvious that a negative expansion is a valuable property in a glass which becomes reheated by the nuclear waste it contains. While the metal container expands, this glass contracts, thereby obviating external stress which might crack the glass block otherwise.

When a synthetic mixture of chemical oxides was added to the $Al_3P_7O_{22}$ melt in quantities to simulate the HLW additives, I determined two essential factors, which set my new and improved glass apart from any prior known glasses used heretofore in the field of nuclear waste encapsulation. The first is that the HLW-PAP glass would not devitrify under any circumstances employed. This was first observed visually and confirmed several times by differential thermal analysis, an analytical method commonly used to determine thermal behavior of glasses. This is entirely unexpected and unique since my glass is the only one observed to date which does not devitrify when containing HLW. This unique non-devitrification behavior appears to be dependent upon at least two factors, the chemical composition of the HLW, and the minimal quantity added. While it is not certain, the presence of molybdenum appears to be one of the factors affecting the non-devitrifying properties of the HLW-PAP glass combination. Table II shows a typical HLW composition in terms of a compositional mixture used to simulate a typical high level waste:

TABLE II

| Compound | grams added | Compound | grams added |
|---|---|---|---|
| $Ba(OH)_2$ | 5.77 | CdO | 0.31 |
| $CeO_2$ | 20.94 | $Eu_2O_3$ | 0.66 |
| $Gd_2O_3$ | 0.46 | KOH | 12.77 |
| $La_2O_3$ | 4.88 | $MoO_3$ | 17.13 |
| $Nd_2O_3$ | 15.29 | $Pr_6O_{11}$ | 4.93 |
| $Sm_2O_3$ | 3.07 | $SrCO_3$ | 4.97 |
| $Y_2O_3$ | 2.01 | $ZrO_2$ | 16.31 |
| $MnO_2$ | 1.36 | | |

All of the above compounds are oxides, or compounds which break down to oxides when heated. The overall composition is similar to a standard synthetic waste, ie—PW-7a, already defined in the prior art, with $Nd_2O_3$ substitution for the actinides, $K_2O(KOH)$ for Cs and Rb, and $MnO_2$ for $Tc_2O_7$ and $RuO_2$. Although non-radioactive in nature, this mixture has identical chemical properties to a radioactive mixture obtained from fission processes in a nuclear power plant. When added to PAP glass, the HLW-PAP glass product does not devitrify when a 20% by weight HLW: 80% by weight PAP glass composition is prepared. Below about 10% HLW, the devitrification begins to appear as an extremely slow process, as indicated by microscopic flakes on the surface of a glass bar heated to 1200° C. for 36 hours. About 5% HLW appears to be the minimum, ie—5% HLW: 95% PAP glass, to produce a non-devitrifying (very slow) HLW glass composition. However, if a 20% HLW: 80% PAP glass bar is heated in an alumina boat for 96 hours at 1500° C., it merely sags and no devitrification takes place. This thermal treatment should accelerate the solid state reaction kinetics of devitrification by about 2.1 million times. The fact that devitrification does not appear means that it is practically non-existent in the 20% HLW-80% PAP glass formulation.

The second factor is that the hydrolysis loss of HLW-PAP glass is related to the polymerization time. The relation has been determined to be linear and fits the equation:

$$Wt = 0.0473t - 0.799, \quad (5)$$

where Wt is the weight change observed in $10^{-6}$ gm./cm$^2$/hr. and t is the polymerization time in hours. At 4 hours polymerization time, a loss of $0.61\times10^{-6}$ gm./cm$^2$/hr. in boiling water was observed, whereas at 24 hours polymerization time, a gain of $0.33\times10^{-6}$ gm./cm$^2$/hr. was determined. According to the above equation, a polymerization time of 17.0 hours polymerization time ought to give a zero change in weight. When this was tried, the result was a loss, $1.91\times10^{-7}$ gm./cm$^2$/hr. ($4.6\times10^{-6}$ gm./cm$^2$/day). This is some 15 times lower than that of HLW-ZBS glass. These results were obtained by measuring the physical dimensions of the glass bar and immersing it in boiling water for 96 hours. The behavior of my new glass is unusual, especially for HLW-PAP glass, as shown in Table III. These data were obtained for a HLW-PAP glass rod in which the glass had been polymerized for 17.0 hours at 1350° C. before casting the melt.

TABLE III

Effect of Drying Time on Weight Changes Observed for a 17 Hour Polymerized HLW-PAP Glass

| Time After Removal From Boiling Water (96 Hour Immersion) | Weight Gain ($\times 10^{-6}$ gm./cm$^2$/hr.) |
|---|---|
| 0 hour | 0.321 |
| 1 hour | 0.512 |
| 2 hour | 0.374 |
| 3 hour | 0.333 |
| 18 hour | 0.206 |
| 25 hour | 0.153 |
| 67 hour | 0.092 |
| 72 hour | 0.076 |

This behavior indicates that the surface of the HLW-PAP glass becomes hydroxylated and that the actual weight loss (or gain) is really zero (at 17.0 hours polymerization time). This was estimated by fitting the data of Table III to an exponential decay equation, starting with 1 hour drying time. The statistical fit is 97% and the equation obtained was:

$$Wt = 0.370 \exp. -0.0233t \quad (6)$$

Extrapolating the gain from 72 hours to one week gives a value of $7.4\times10^{-9}$ gm./cm$^2$/hr., that for 2 weeks is: $1.5\times10^{-10}$, while the value calculated for 4 weeks is: $Wt = 5.9\times10^{-11}$ gm./cm$^2$/hr., as a final weight loss. This illustrates the fact that the gain change observed for the glass rod is reversible and is caused by the boiling water at the surface of the glass rod. The weight change then reequilibrates, with time, back to its original value. In other words, only the surface of the glass is affected but it reverts back to its original state once the boiling water is removed. This proves that the change within the glass matrix is actually zero in accordance with the experimentally determined equation (5) for 17.0 hours polymerization time. However, I have determined that this value is also a function of the polymerization time as well. All of the above data were taken at a temperature of 1350° C. On a practical basis, it is possible to melt the HLW-precursor mixture at about 1350° C. and then change the melt temperature to accelerate or decelerate the polymerization process. For example, I have shown that it is necessary to hold the melt for about 17.0 hours at 1350° C. to obtain a glass surface which substantially is free from the effects of hydrolytic etching. To achieve the same condition at 1450° C. requires only about 4 hours but 44 hours at 1250° C. When the melt temperature is reduced to about 1200° C., the required time to achieve the desired degree of polymerization of the melt, in the presence of HLW, is increased to 153 hours (about 6 days). Thus, it is preferable to employ the higher temperatures to achieve the degree of polymerization sought, to maximize the level of resistance of the glass surface to hydrolytic etching.

The other experimental equations relating to these other temperatures were:

$$1200° \text{ C.: } Wt=0.0052t-0.797 \quad (7)$$

$$1250° \text{ C.: } Wt=0.0183t-0.798 \quad (8)$$

$$1450° \text{ C.: } Wt=0.188t-0.800, \quad (9)$$

where t is in hours.

An alternate method is to prepare the glass separate from the HLW, and allow it to polymerize for the required time. A glass frit is then prepared and mixed with HLW in desired proportion. This mixture is then heated, whereupon the glass softens at about 850° C. and begins to dissolve the HLW. The melt is held at 1150° C. until the dissolution process is complete, whereupon the melt is cooled to form the HLW-PAP glass from, for long term storage thereof.

I have also determined that the weight changes as related to glass surface hydroxylation, are affected by the specific methods of HLW-PAP glass preparation. The results shown in Table IV were obtained at 1350° C.

TABLE IV

Effect of HLW-PAP glass Preparation Method Upon Resistance to Surface Hydroxylation

| Material Used to Make Melt | Excess $H_3PO_4$ Present | Purity of Material | Polymerization Time | Weight Change Observed* ($10^{-6}$ gm/cm²/hr) gain | loss | at 72 hrs. |
|---|---|---|---|---|---|---|
| precursor crystals | 20% | high | 4 hr. | — | 0.61 | — |
| " | " | " | 17 hr. | 0.021 | — | — |
| " | " | " | 24 hr. | 0.33 | — | — |
| " | " | " | 48 hr. | 1.44 | — | — |
| " | " | " | 72 hr. | 2.62 | — | — |
| prefire (calcine) | | | | | | |
| prefire high | 72 hr. | 0.10 | — | 0.14 | | |
| " | none | " | " | 0.20 | — | 0.24 |
| " | none | " | 17 hr. | 0.25 | — | 0.011 |
| " | none | low | 17 hr. | 0.22 | — | 0.12 |
| " | 20% | high | 17 hr. | 0.22 | — | 0.016 |

*96 hours in boiling water

The data in Table IV show (1) the prefire is a better method and a better material with which to make the melt, (2) the convertion of HLW to phosphates is indicated as a better method to approach zero weight loss, and (3) purification of the precursor crystals gives a HLW-PAP glass form with essentially no weight change, i.e., $1.6\times10^{-8}$ gm./cm²/hr. or $3.8\times10^{-7}$ gm./cm²/day, as a gain. Undoubtedly, this will revert to zero as the surface continues to dehydroxylate with time.

The molecular glass has other interesting properties in regard to the HLW encapsulation application. The melt dissolves all metals including the noble metals (Pt is very slow but Rh and Pd dissolve rapidly). All oxides, or compounds which decompose to form oxides, do dissolve, including the refractory oxides, $CeO_2$, $ZrO_2$ and $RuO_2$. No crystal formation has been observed at any time from HLW additives, unless the polymerization time exceeds about 36 hours, when $AlPO_4$ crystals appear. The melt has a low viscosity of about 180 poise.

The amount of HLW additives can be varied from about 4% by weight to 96% by weight of glass, to an upper limit of about 47% of HLW by weight combined with 53% by weight of glass. I prefer to use about 20%-25% by weight of HLW additivies, although one is not limited to this, as is well known in the art.

It will be recognized that the instant invention arises from the application of my novel polymerized molecular phosphate glass to the encapsulation of high-level radioactive nuclear waste for disposal thereof. Although I have given data and results which stemmed from the aluminum cationic variety of my new glass, other cations can be employed for the same purpose, using the methods and approaches given herein as applying to my new and improved invention. Two trivalent cations which may be substituted for the aluminum are $In^{3+}$ and $Ga^{3+}$; however, these materials are considerably more expensive and have a larger cross-section for neutron capture than aluminum. A particular advantage of using aluminum is its low nuclear capture cross-section and absorption, as compared with indium and gallium and as compared with zinc borosilicate (ZBS) glasses of the prior art. This transparency to nuclear particles reduces the possibility of radiation damage to the molecular structure, and minimizes the generation of thermal energy.

As examples of the invention, I cite:

EXAMPLE I

To prepare the precursor compound, measure out 970 ml. of reagent grade, 85% $H_3PO_4$ (specific gravity of 1.689 gm/cc), although other, lower grades can be used as well, and add to 1000 ml. of water. Dilute to 2000 ml. total volume. Weigh out 156.0 gm. of $Al(OH)_3$ and dissolve in $H_3PO_4$ solution. Heating may be necessary to obtain a clear solution. Weigh out 5.0–10.0 gm. of ammonium 1-pyrrolidine dithiocarbamate (APC) and dissolve in 50 ml. of water. Add to solution. Filter off the dark grey precipitate using a 0.45 micron filter. Set up a mercury-pool electrolysis apparatus and electrolyze solution in a nitrogen atmosphere at −2.90 VDC at Hg pool for several hours to remove residual impurities. A minimum of 2 hours is required before most of the impurities are removed. Evaporate the purified solution slowly, using a heat source, to obtain precursor crystals plus a liquid. The liquid contains excess $H_3PO_4$ plus water. The excess liquor is decanted and the crystals are washed free of excess $H_3PO_4$, using methyl-ethyl ketone as a washing agent. Assay the washed and dried crystals.

Add 20.0 gm. of HLW additives per 96.5 gm. of crystals (assuming the experimental assay to be 83.0%); the total volume used should fill the container used for heating. Heat at a rate of about 10°-12° C. per minute to cause initial dehydration and polymerization. As the temperature rises to 1350° C., a melt will form, with a shrinkage of about 80%. More HLW-crystal mix is added until the container is filled with melt. This takes about 1 hour. Hold the melt about 16 hours longer to reach a suitable degree of polymerization, and then cast the melt in a suitable mold to form the final HLW-PAP glass slug, for long term storage thereof. No annealing is necessary but very large pieces may require a minimal annealing. Molecular glasses require that annealing be done some 8°-18° C. above the softening point.

EXAMPLE 2

Alternately, the methods of Example I are followed except that the HLW is not added at the point of initial firing. The precursor crystals are heated separately at a rate of about 10° C. per minute to 1100° C. and then held there for several hours to form a calcine powder. This powder, which is partially polymerized, is cooled and mixed with HLW at a rate of 80.0 gm. of calcine powder to 20.0 gm. of HLW additives, heated to 1350° C. to form a melt which is held at this temperature for 17.0 hours to complete polymerization and then cast in final form for long term storage thereof.

EXAMPLE 3

Another alternate method is to heat the precursor crystals to induce initial polymerization and then to obtain the melt. The melt is then cast immediately and cooled. The resulting glass is ground to obtain a glass frit which is then used to encapsulate the HLW additives according to methods of Example 2. In this case, the frit softens at 850° C. and is liquid at 1150° C. This melt is used for the encapsulation of HLW additives according to methods given above. This method has the advantage that much lower temperatures can be used when the final casting container to be used for long term storate cannot withstand the higher temperatures required for production of a direct melt.

EXAMPLE 4

The procedure given in Example 1 is followed except that the crystals are not washed free of excess $H_3PO_4$. A portion of the crystals are assayed. The assay is used to calculate the weight of crystals plus phosphoric acid needed to obtain 0.20 HLW-0.80 PAP glass on a weight basis. The HLW, added prior to heating, begins to form phosphates. Upon heating, phosphate formation is accelerated and is complete by the time melt temperature is reached. The formation of HLW-phosphates accelerates the dissolution of HLW into the melt, and aids dispersion thereof. Further procedures of Example 1 are then followed.

EXAMPLE 5

The procedure of Example 2 is followed to obtain a calcine. Both HLW additives and $H_3PO_4$ are added at a ratio of 207 ml. of 85% $H_3PO_4$ per 100 gm. of HLW additives, to form a final composition of 0.20 HLW-0.80 PAP glass by weight. The HLW-$H_3PO_4$ mixture is thoroughly blended before it is added to the calcine, and then the final mixture is heated according to the procedures of Example 2 to form the melt, to form the final glass composition of 0.20 HLW-0.80 PAP glass, for storage thereof.

EXAMPLE 6

If a glass frit is to be used, the procedures of Examples 3 and 5 are followed except that the $H_3PO_4$ is mixed with the HLW additives prior to addition to the glass former, and is gently heated to 100°-150° C., as required, to induce frothing and phosphate formation. When phosphate formation is complete, the HLW-phosphates are added to the PAP glass-frit to form a 0.20 HLW-0.80 PAP glass composition mixture, and the mass is heated at a rate of 8°-10° C. per minute to 825° C. where the frit softens. The heating is continued up to 1100°-1150° C. where the melt is held for several hours until the HLW additives can dissolve and become dispersed within the melt. The melt is then cast and handled according to procedures already developed in prior examples.

EXAMPLE 7

The above examples give methods suitable for HLW encapsulation by PAP glass using a static or single container method. If a continuous method is desired, there are several alternatives. A glass melting furnace capable of operating continuously at 1400° C. is set up and made ready for operation. Such furnaces generally are composed of a preheat chamber, a melt chamber and a holding tank. It is essential that the inner faces of each chamber be lined with impervious (high density) alumina, which is the only material found to be sufficiently resistant to etching by the very corrosive melt. A mixture of HLW additives and precursor crystals is added to the preheat chamber to form a melt. As the volume of melt increases, the melt moves over into the melt chamber and finally to the hold chamber. HLW-phosphates are added simultaneously with the PAP calcine, to form more melt, at a ratio so as to maintain a ratio in the general range of 0.20 HLW-0.80 PAP glass in the final product. It is essential that the throughput of the HLW-PAP glass be about 8-9 hours in order for sufficient polymerization to take place before the glass-casting is formed. Therefore the rate of addition of the HLW-calcine powder must be adjusted according to the size of furnace used so as to obtain about 8-9 hours of polymerization time.

The addition of HLW additives can take at least two forms, as oxides obtained by drying or calcining the high-level liquid wastes, or as phosphates obtained by the addition of $H_3PO_4$ to the liquid wastes, followed by separation thereof of the radioactive precipitated wastes as phosphates.

The melt can be formed from precursor crystals (unwashed or washed precursor crystals) or PAP-calcine powder. When HLW-calcine is to be used, it is better to use unwashed crystals containing excess $H_3PO_4$ to convert the HLW oxides to phosphates in the preheat chamber of the furnace. If HLW-phosphates are used, then PAP-calcine can be used and added simultaneously to the preheat chamber.

The HLW-PAP glass melt is continuously drawn from the holding chamber of the glass furnace, the melt having a residence time of 8-9 hours before casting into a suitable container for long term storage thereof.

EXAMPLE 8

When a glass frit is to be used on a continuous casting basis, the method to be employed is somewhat different than that of Example 7. The HLW plus glass frit, or alternatively the HLW-phosphates plus glass frit are mixed together in a ratio of about 0.20 HLW-0.80 PAP glass frit, but not to exceed about 0.45 to 0.55, and added directly to a heated container, held at about 1150° C. The addition is fairly slow so as to give the melt enough time to form. If the cannister is stainless steel, the addition rate can be faster then if it is alumina, which has a lower heat transfer rate from the furnace. After the cannister is full, the melt is held at 1150° C. so that the total melt-hold-time is about 17 hours. The cannister is then cooled slowly and made ready for long term storage, as is known in the prior art.

While the invention has been described hereinabove in terms of the preferred embodiments and specific examples, the invention itself is not limited thereto, but rather comprehends all such modifications of, and variations and departures from these embodiments as properly fall within the spirit and scope of the appended claims.

I claim:

1. A nuclear waste block for storage of high level radioactive waste, said block comprising, in combination: about 4 to 47 parts by weight of solid radioactive waste material dispersed in 96 to 53 parts by weight, respectively, of a polymeric phosphate glass having the formula:

$$M_3P_7O_{22},$$

where M is a trivalent metal selected from the group consisting of aluminum, indium and gallium.

2. The nuclear waste block of claim 1, wherein said metal is aluminum.

3. The nuclear waste block of claim 1, wherein said metal is indium.

4. The nuclear waste block of claim 1, wherein said metal is gallium.

5. A process of using a polymeric phosphate glass having the formula:

$$M_3\,P_7\,O_{22},$$

where M is a trivalent metal selected from the group consisting of aluminum, indium and gallium, said process comprising the steps of:

forming a melt of said glass;

dissolving high level radioactive waste in said melt in the amount of about 4 to 47 percent by weight of the total weight of the radioactive waste plus said glass;

allowing said melt incorporating said radioactive waste to cool and solidify into a block;

said block with its encapsulated radioactive waste being suitable for prolonged or permanent storage.

6. The process of claim 5, wherein said metal is aluminum.

7. The process of claim 5, wherein said metal is indium.

8. The process of claim 5, wherein said metal is gallium.

9. The process of claim 5, further comprising the steps of transporting said block to a permanent storage site and depositing said block at said site.

10. A process of encapsulating high level radioactive waste for prolonged or permanent storage, said process comprising the steps of:

forming a melt of a polymeric phosphate glass having the formula:

$$M_3\,P_7\,O_{22},$$

where M is a trivalent metal selected from the group consisting of aluminum, indium and gallium;

dissolving high level radioactive waste in said melt in the amount of about 4 to 47 percent by weight of the total weight of the radioactive waste plus said glass;

allowing said melt incorporating said radioactive waste to cool and solidify into a block.

11. The process of claim 10, wherein said metal is aluminum.

12. The process of claim 10, wherein said metal is indium.

13. The process of claim 10, wherein said metal is gallium.

14. The process of claim 10, wherein said melt forming step includes:

preparing precursor crystals having the formula: $M(H_2\,PO_4)_3$, wherein M has been defined above;

adding radioactive waste crystals to said precursor crystals to form a crystal mixture;

heating said crystal mixture to induce solid state polymerization and form said melt.

15. The process of claim 14, wherein said melt forming step further includes washing said precursor crystals substantially free of phosphoric acid prior to adding radioactive waste crystals.

16. The process of claim 14, wherein the impurity level of said precursor crystals does not exceed 300 ppm.

17. The process of claim 14, wherein said mixture is heated to a temperature of approximately 1350° C.

18. The process of claim 14, wherein said crystal mixture includes phosphoric acid.

19. The process of claim 14, further comprising the step of heating said precursor crystals to form a calcine prior to adding said radioactive waste crystals.

20. The process of claim 10, wherein said melt forming step includes:

preparing precursor crystals having the formula: $M(H_2PO_4)_3$, wherein M has been defined above;

heating said precursor crystals to induce solid state polymerization and form a first melt;

allowing said first melt to cool;

grinding the cooled glass to form a glass frit;

adding radioactive waste crystals to said glass frit to form a glass-crystal mixture; and heating said glass-crystal mixture to form a second melt.

21. The product produced by the process defined in any one of claims 10–20.

22. A nuclear waste block for storage of high level radioactive waste, said block comprising, in combination: about 4 to 47 parts by weight of solid radioactive waste material dispersed in 96 to 53 parts by weight, respectively, of polymeric phosphate glass having the formula:

$$M(PO_3)_3,$$

where M is a trivalent metal selected from the group consisting of aluminum, indium and gallium.

23. A nuclear waste block of claim 22, wherein said metal is aluminum.

24. The nuclear waste block of claim 22, wherein said metal is indium.

25. The nuclear waste block of claim 22, wherein said metal is gallium.

26. The nuclear waste block defined in any one of claims 22–25, wherein said polymeric phosphate glass further includes $M_3\,P_7\,O_{22}$, wherein M has been defined above.

27. A process of using a polymeric phosphate glass having a formula:

$$M(PO_3)_3,$$

where M is a trivalent metal selected from the group consisting of aluminum, indium and gallium, said process comprising the steps of:

forming a melt of said glass;

dissolving high level radioactive waste in said melt in the amount of about 4 to 47 percent by weight of the total weight of the radioactive waste plus said glass;

allowing said melt incorporating said radioactive waste to cool and solidify into a block;

said block with its encapsulated radioactive waste being suitable for prolonged or permanent storage.

28. The process of claim 27, wherein said metal is aluminum.

29. The process of claim 27, wherein said metal is indium.

30. The process of claim 27, wherein said metal is gallium.

31. The process of claim 27, further comprising the steps of transporting said block to a permanent storage site and depositing said block at said site.

32. The process of using defined in any one of claims 27-31, wherein said polymeric phosphate glass further includes $M_3 P_7 O_{22}$, wherein M has been defined above.

33. A process of encapsulating high level radioactive waste for prolonged or permanent storage, said process comprising the steps of:

forming a melt of a polymeric phosphate glass having a formula:

$$M(PO_3)_3,$$

where M is a trivalent metal selected from the group consisting of aluminum, indium and gallium;

dissolving high level radioactive waste in said melt in the amount of about 4 to 47 percent by weight of the total weight of the radioactive waste plus said glass;

allowing said melt incorporating said radioactive waste to cool and solidify into a block.

34. The process of claim 33, wherein said metal is aluminum.

35. The process of claim 33, wherein said metal is indium.

36. The process of claim 33, wherein said metal is gallium.

37. The process of claim 33, wherein said melt forming step includes:

preparing precursor crystals having the formula:

$$M(H_2 PO_4)_3,$$

adding radioactive waste crystals to said precursor crystals to form a crystal mixture;

heating said crystal mixture to induce solid state polymerization and form said melt.

38. The process of claim 37, wherein said melt forming step further includes washing said precursor crystals substantially free of phosphoric acid prior to adding radioactive waste crystals.

39. The process of claim 37, wherein the impurity level of said precursor crystals does not exceed 300 ppm.

40. The process of claim 37, wherein said mixture is heated to a temperature of approximately 1350° C.

41. The process of claim 37, wherein said crystal mixture includes phosphoric acid.

42. The process of claim 37, further comprising the step of heating said precursor crystals to form a calcine prior to adding said radioactive waste crystals.

43. The process of claim 33, wherein said melt forming step includes:

preparing precursor crystals having the formula:

$$M(H_2PO_4)_3;$$

heating said precursor crystals to induce solid state polymerization and form a first melt;

allowing said first melt to cool;

grinding the cooled glass to form a glass frit;

adding radioactive waste crystals to said glass frit to form a glass-crystal mixture; and heating said glass-crystal mixture to form a second melt.

44. The process of encapsulating defined in any one of claims 33-43, wherein said polymeric phosphate glass further includes $M_3 P_7 O_{22}$, wherein M has been defined above.

45. The process of claim 33, wherein said melt forming step includes the steps of:

precipitating $M(PO_3)_3$ by combining a purified solution of a soluble salt of the metal M, wherein M has been defined above, with a purified solution of metaphosphoric acid; and heating the $M(PO_3)_3$ to form a polymerized melt.

46. The process of claim 45, wherein said soluble salt is $M(NO_3)_3$.

47. The process of claim 45, wherein the impurity level of said soluble salt does not exceed 300 ppm.

48. The process of claim 45, wherein the impurity level of said metaphosphoric acid does not exceed 300 ppm.

49. The product produced by the process defined in any one of claims 33-43 and 45-48.

50. The process defined in either one of claims 14 or 37, wherein said melt is maintained at at least one elevated temperature for a prescribed period of time dependent upon said at least one temperature in order to induce high resistance to hydrolytic etching at the surface of said block.

51. The process defined in claim 50, wherein said temperature is substantially 1200° C. and said period is substantially 153 hours.

52. The process defined in claim 50, wherein said temperature is substantially 1250° C. and said period is substantially 44 hours.

53. The process defined in claim 50, wherein said temperature is substantially 1350° C. and said period is substantially 44 hours.

54. The process defined in claim 50, wherein said temperature is substantially 1350° C. and said period is substantially 17 hours.

55. The process defined in claim 50, wherein said temperature is substantially 1450° C. and said period is substantially 4 hours.

56. The process defined in either one of claims 20 or 43, wherein one of said first and second melt is maintained at at least one elevated temperature for a prescribed period of time dependent upon said at least one temperature in order to induce high resistance to hydrolytic etching at the surface of said block.

57. The process defined in claim 56, wherein said one melt is said first melt.

58. The process defined in claim 56, wherein said one melt is said second melt.

59. The process defined in claim 56, wherein said temperature is substantially 1200° C. and said period is substantially 153 hours.

60. The process defined in claim 56, wherein said temperature is substantially 1250° C. and said period is substantially 44 hours.

61. The process defined in claim 56, wherein said temperature is substantially 1350° C. and said period is substantially 17 hours.

62. The process defined in claim 56, wherein said temperature is substantially 1450° C. and said period is substantially 4 hours.

* * * * *